US006464730B1

(12) United States Patent
Login et al.

(10) Patent No.: US 6,464,730 B1
(45) Date of Patent: Oct. 15, 2002

(54) PROCESS FOR APPLYING SOFTENERS TO FABRICS

(75) Inventors: Robert B. Login, Simpsonville, SC (US); Otto Bella, Tryon, NC (US); Calvin McIntosh Wicker, Jr., Spartanburg, SC (US); Lynn Hosie, Charlotte, NC (US); David MacEwan, Greenville, SC (US); Robert Barile, Marmora, NJ (US)

(73) Assignee: Sybron Chemicals, Inc., Wellford, SC (US)

( * ) Notice: Subject to any disclaimer, the term of this patent is extended or adjusted under 35 U.S.C. 154(b) by 0 days.

(21) Appl. No.: 09/591,152

(22) Filed: Jun. 9, 2000

Related U.S. Application Data

(63) Continuation-in-part of application No. 09/157,643, filed on Sep. 21, 1998, now Pat. No. 6,149,549.

(51) Int. Cl.[7] ..... D06M 11/66; D06M 13/325

(52) U.S. Cl. ..... 8/116.1; 8/127; 8/181; 8/188; 8/194; 8/195; 8/196

(58) Field of Search ..... 8/116.1, 127.1, 8/181, 188, 194, 195, 196; 510/515

(56) References Cited

U.S. PATENT DOCUMENTS

| | | | |
|---|---|---|---|
| 2,511,229 A | | 6/1950 | Thomas |
| 2,681,846 A | | 6/1954 | Guthrie et al. |
| 2,726,133 A | | 12/1955 | Heifenberger et al. |
| 2,935,471 A | | 3/1960 | Aarons et al. |
| 3,674,418 A | | 7/1972 | Lyons et al. |
| 4,181,498 A | | 1/1980 | Koltai et al. |
| 5,478,489 A | | 12/1995 | Abdennaceur et al. |
| 5,490,865 A | | 2/1996 | Scheiwiller |
| 6,149,549 A | * | 11/2000 | Login et al. |

FOREIGN PATENT DOCUMENTS

| | | |
|---|---|---|
| IN | 145884 | 1/1979 |
| IN | 147522 | 3/1980 |
| JP | 49013499 | 2/1974 |
| JP | 4933718 | 9/1974 |
| JP | 53143786 | 12/1978 |
| JP | 5502688 | 6/1980 |
| JP | 55082688 | 6/1980 |
| JP | 60151373 | 8/1985 |

OTHER PUBLICATIONS

"Flame–Resistant Cellulose Esters", by P. Isaacs et al., Textile Research Journal, Sep. 1974.

"Sulfonation and Related Reactions", by Everett E. Gilbert, Interscience Monographs on Chemistry, Inorganic Chemistry Section, pp. 24–25, 258–261, 268–269, 272–273, 276–277, 282–283, 300–301, 354–361, 506–507 (1965).

"Dyeing and Mechanical Properties of Cotton Modified for Cationic Dyes with Hydrophobic and Acidic Groups", by Kazuhiko Fukatsu, Textile Research Journal, Mar. 1992, pp. 135–139.

"Differential Dyeing Cotton. 1–Preparation and Evaluation of Differential Dyeing Cotton Yarn", by Jacqueline A. Clipson et al. JSDC, vol. 105, pp. 159–162, Apr. 1989.

"N–Methylol–2–Pyrrolidone–5–Carboxylic Acid, A Convenient Compound for Incorporating a Carboxyl Group Onto Cellulose", letter by John D. Turner, Textile Research Journal, Apr. 1975, pp. 354–355.

"Pad–Bake Reactions, Part 1: A New Pad–Bake Reaction of Cellulose and Aqueous Solutions of Amic Acids", by J.A. Cuculo, Textile Research Journal, Apr. 1971, pp. 321–326.

"Pad–Bake Reactions, Part II: A New Pad–Bake Reaction of Cellulose and Aqueous Solutions of Anhydridge–Ammonia", by J.A. Cuculo, Textile Research Journal, May 1971, pp. 375–378.

"Heat Transfer in Products of Emulsion Polymerization", by Matejicek, et al., Chem. Prum., 1980, pp. 116–121.

"Reactions of Wool with Sulfamic Acid", by B.A. Cameron et al., Textile Research Journal, Nov. 1987, pp. 619–624.

"Dyeing Properties of Sulphamic Acid–Treated Wool", by B.A. Cameron et al., JSDC vol. 103, Jul. /Aug. 1987, pp. 257–260.

* cited by examiner

*Primary Examiner*—Margaret Einsmann
(74) *Attorney, Agent, or Firm*—Dority & Manning, P.A.

(57) ABSTRACT

The present invention is generally directed to a process for making fabrics containing cotton fibers more aesthetically pleasing and resistant to staining by anionic dyes by derivatizing the cotton so that it exhibits a permanent anionic charge. By increasing the anionic charge of the fibers, the fibers become resistant to anionic coloring agents which may undesirably come into contact with the fibers and the fibers can absorb greater amounts of cationic softeners and biocides. Furthermore, the negative charges repel each other resulting in a fabric with greater loft and hydrophilicity. This results in greater smoothness, better hand, and more comfort. Besides being used to prevent the cross-staining of fabrics, the present invention can also be used to make carpet materials resistant to anionic staining agents.

23 Claims, No Drawings

PROCESS FOR APPLYING SOFTENERS TO FABRICS

RELATED APPLICATIONS

The present application is a Continuation-in-Part application of U.S. patent Ser. No. 09/157,643 filed on Sep. 21, 1998 now U.S. Pat. No. 6,149,549.

FIELD OF THE INVENTION

In general, the present invention is directed to a process for improving cotton fibers and textile products containing cotton fibers by, for example, making them resistant to cross-staining. In particular, the present invention is directed to an anionic treatment process for cotton fibers that makes the fibers repel anionically-charged dyes and auxiliaries or attract cationically charged dyes and auxiliaries.

BACKGROUND OF THE INVENTION

The problem of cross-staining between cotton fabrics during laundering and processing is a significant household and textile problem. Cross-staining relates to the transferring of dye that may occur between fabrics under either wet or dry conditions while fabrics are being manufactured, processed or laundered. Television commercials are aired daily for expensive detergents meant to minimize cross-staining. In fact, much advertising and product manufacturing are devoted to this common annoyance. The detergents that advertise colorfastness are designed to approach the problem of cross-staining through the use of dye antiredeposition agents that are incorporated into their formulas. These antiredeposition agents, however, add expense to the detergents and are not fully effective in preventing cross-staining. Thus, a method of preventing dye transfer without relying on the use of detergents would prove to be both practical and economical.

The dye transfer between cellulosic fabrics, such as cotton fabrics, occurs when fabrics are laundered or processed in the same bath. Dye transfer occurs because cellulosic fibers have a mild attraction for anionic classes of dyes, which are the majority of the dyes now employed to dye cotton and other cellulosic fabrics and blends. Dyes are made to be anionic or negatively charged so that they will benefit from water solubility. Such classes of dyes include reactives, directs, acids, and the like. A primary example of this dye transfer is the staining of the white pockets in blue jeans during garment manufacture and during laundering. The anionic leuco form of the indigo dyes in the blue jeans are absorbed by the undyed cotton fibers in the pockets because of their chemical attraction to one another.

An even more well-known example is the transfer of dyes between dark-colored garments and white or light-colored garments during the laundering process. The loosely-held anionic dyes in the fibers of the dark-colored garments stain the white or light-colored garments. This dye transfer may adversely affect white or light-colored garments. Similarly, striped or patterned garments containing both dark-colored fabric and white or light-colored fabric may experience bleeding of the dark-colored dyes on to the lighter portions because of the attraction of unfixed anionic dyes to the cellulosic fibers in the white or light-colored portions. Therefore, it is evident that weakening this attraction between the anionic dyes and the cotton fibers would provide a solution to the problem of dye transfer.

A need currently exists for a solution to the problem of dye transfer regarding cellulosic fabrics so that the needs for expensive detergents and other methods of colorfastness are eliminated. In particular, a need exists for a process that treats cellulosic fibers in order to permanently increase their anionic character so that these fibers are able to resist anionic dyes that cross stain fabrics. The present invention is directed to a process that meets the above described need.

SUMMARY OF THE INVENTION

The present invention recognizes and addresses the foregoing disadvantages and drawbacks of prior art constructions. Accordingly, it is an object of the present invention to provide a process for making cellulosic fibers, such as cotton fibers, and textile products made from the fibers anionic, resistant to cross-staining, and improved as far as hand, appearance, and comfort.

Another object of the present invention is to provide a process for making cotton fibers resistant to cross-staining through a permanent anionic treatment.

Another object of the present invention is to provide a process that not only makes cotton fibers resistant to cross-staining, but also provides the fibers with a greater attraction to cationic fabric softeners and bacteriocides.

It is another object of the present invention to provide a process for treating cotton fibers with a softener that results in a fabric having great softness properties, good durability, and in which the softener is wash resistant.

Another object of the present invention is to provide a process for treating cotton fibers in a manner that permits the fibers to become bonded with bacteriocides at high and effective concentration levels.

Still another object of the present invention is to provide a process for treating cotton fibers or textiles containing cotton fibers with a sulfamate, which increases the anionic charge of the material.

Another object of the present invention is to treat cotton fibers, or textiles made from the fibers, with a pre-formed complex containing sulfamic acid and urea such that a material resistant to cross-staining can be formed at lower temperatures.

It is another object of the present invention to treat cotton fibers, or textiles made from the fibers, with a pre-formed complex containing sulfamic acid and urea, wherein the sulfamic acid is present in a sufficient amount to prevent misting of the urea when the complex is heated.

These and other objects of the present invention are achieved by providing a process for making fabrics containing cellulosic fibers, particularly cotton fibers, resistant to cross-staining. More particularly, the fabrics become resistant to being stained by anionic coloring agents that may undesirably contact the fabric during the manufacture of the fabric or during laundering or some other aqueous process. Furthermore, fibers used in cotton carpeting become resistant to being stained by accidental spillage.

The process includes the steps of providing a fabric containing cotton fibers. The fabric can be pre-dyed and/or can be in a substantially finished state. The fabric is contacted with a solution that includes a pre-formed complex. The complex contains a derivatising agent. For instance, the agent can be sulfamic acid. In addition, the complex can also contain other materials, such as urea.

Once contacted with a derivatising agent contained within the pre-formed complex, the fabric is heated to a temperature sufficient for the agent to react with the cellulosic fibers contained within the fabric. Through this reaction, the anionic charge of the cellulosic fibers is increased for making the fibers more resistant to anionic coloring agents during casual contact. Moreover, the use of a preformed complex allows such an anionic charge to be achieved at relatively low temperatures.

Although the combination of sulfamic acid and urea will sulfate cotton, it is but one of several methods according to the present invention of permanently rendering cotton anionic in charge. It is the anionic charge and not the reagents or structure of the anionic derivative that matters, but the negative (anionic) charge itself that is the means of achieving the benefits of this invention.

For most applications, the process of the present invention is used to protect predyed and preformed fabrics from staining during consumer laundering. It should be understood, however, that the process of the present invention can also be used to treat fibers themselves prior to being formed into a fabric or garment.

As described above, in one embodiment, the sulfating agent is sulfamic acid. In this embodiment, the sulfating agent can be carefully mixed with an amide of a carboxylic acid, such as urea under controlled conditions, to form a complex prior to being applied as an aqueous solution to the fabric or fibers. It is unknown at this time what type of complex is formed between the sulfating agent and the amide of the carboxylic acid. As used herein, the term "complex" is intended to cover any chemical association or bond. Urea is not only believed to act as a catalyst, but also protects the fabric from yellowing and from being damaged by heat during sulfation.

In one embodiment, a urea-sulfamic acid complex is formed by mixing sulfamic acid with excess urea in a mole ratio of about 1 mole sulfamic acid to about 6 moles urea. The mixture is then heated in the presence of phosphoric acid such that a complex can be formed. The resulting complex can then be diluted with water. In one embodiment, phosphoric acid remains present in the form of ammonium phosphate in an amount of about 0.2 moles for every 1.0 mole of urea.

Prior to sulfation, the fabric or fibers are dried in order to remove substantially all of any moisture present on the fibers. For example, in one embodiment, the fabric can be dried at a temperature of from about 150° F. to about 200° F. prior to sulfation.

It should be understood, however, that other concentrations, parameters, and reagents can be employed to render cellulosics, such as cotton, anionic. Other reagents include $SO_3$, $P_2O_5$, sodium chloroacetate, 115% polyphosphoric acid, maleic anhydride, the reaction product of epichlorohydrin and sodium sulfite or bisulfite, vinyl sulfonate, the condensate of DMDHEU and sulfite, etc.

After drying, the fabrics or fibers can also be cured. When curing a fabric treated with a complex of the present invention, misting can often occur, especially when the complex is heated to temperatures greater than or equal to about 340° F. In one embodiment, to prevent such misting, additional amounts of sulfamic acid can be applied to compensate for any free urea present within the complex. It has been discovered that when additional sulfamic acid is used in a complex of the present invention, a non-volatile salt can form which prevents misting, while still allowing the urea and sulfamic acid to remain functional in the anionic-generating process.

Besides preventing cross-staining, it has been discovered that negatively charged cotton is also able to attract positively charged auxiliaries such as basic dyes. When sufficient negative charge is affixed to cotton, significant levels of basic dyes will readily exhaust.

Negatively charged cotton or more simply anionic cotton will also attract significant amounts of cationic softeners such as fatty quaternaries and amino siloxanes. Further, it has been discovered that once the softener is applied to the cotton, the softener can withstand repeated wash cycles. The level of negative charge will control the amount exhausted. Therefore, by controlling the level of anionic charge, one can control the degree of softener and hence softness of the garment. The ability to achieve maximum softness at low temperatures and very short exhaust cycles (3–5 minutes) has never been achieved prior to this invention.

Cationic biocides can also be exhausted at higher levels than typically achieved on untreated cotton and at levels where more significant efficacy can be achieved.

Anionic cotton will afford garments with greater loft and better smoothing properties (anti-wrinkling). This is because of charge repulsion. With anionic groups, charge repulsion can be a significant force pushing the like charges to repel each other and achieving a farthest separation possible between the fibers resulting in a smoother fabric. Fibrils in the yarns are also repelled from each other and this results in greater loft or bulk.

For these reasons, anionic cotton has a better feel (hand) than untreated fabric even without softeners. This is because the fibrils and yarns are more uniform and bulkier affording a smoother more desirable surface that can be felt and appreciated by the consumer. This is especially evident in loosely constructed fabrics.

The process of the present invention can also be used to treat carpet materials to make them resistant to staining by anionic agents. For instance, carpet materials containing cellulosic fibers, such as cotton fibers, can be sulfated as described above.

Other features of anionic cotton produced according to the present invention are that fabrics made from the cotton have enhanced wrinkle recovery caused by the negative charge repulsion electrostatic effect. For instance, it has been discovered that cotton treated with excess sodium chloroacetate or sulfamic/urea complexes allowed to dry in a smooth wrinkle free state will reorient itself when redried in a tension free environment. In this case, we believe that the negative charges on the cotton repel each other and prefer to orientate back to the most favored positions, which results in smoothing.

For the same reason, the fibrils that make up the yarns when treated repel each other in the resulting fabric increasing loft and resulting in a more open construction that exhibits a more acceptable hand (feel) and transports moisture more easily resulting in greater comfort.

Other objects, features, and aspects of the present invention are discussed in greater detail below.

DETAILED DESCRIPTION OF PREFERRED EMBODIMENTS

The present invention is generally directed to a process which permanently increases the anionic charge of cellulosic fibers, particularly cotton fibers, so that the treated fibers resist being cross stained by anionic dyes. As used herein, derivatising cellulosic fibers refers to a process by which the anionic charge of a cellulosic material becomes permanently increased through the formation of a chemical bond, such as a covalent bond, between the cellulosic material and a derivative, which can be a negatively charged ion. When derivatising cotton fibers according to the present invention, an ester linkage is formed between the derivative and the cotton material.

The anionic treatment process of the present invention is generally accomplished by derivatising the cellulosic fibers in a manner that increases the negative charge of the fibers an amount sufficient for the fibers to repel anionically charged dyes. The treated cellulosic fibers and fabrics made in accordance with the present invention become resistant to cross-staining during laundering or other process treatments. When this occurs, the resulting garment exhibits improved properties such as smoothing, being wrinkle-free, greater loft, improved moisture transport, and greater pick-up of cationic auxiliaries, such as softeners and biocides.

The invention described herein introduces a method in which colorfastness and dye transfer resistance become objectives for the manufacturers of cellulosic fabrics and no longer serve as objectives for the manufacturers of expensive detergents. The scope of the present invention encompasses a widely known household problem and brings about a practical solution to this problem. Resolving this problem is also an indicator of the other previously mentioned benefits such as greater absorption of softeners.

The present invention has multiple applications that reward both consumers and manufacturers with many advantages. The process of anionically treating the cellulosic fibers in white or light-colored fabrics prevents the fabrics from being cross stained while in the same bath with dark-colored fabrics. The treatment process also impedes the ability of colors on the same garment to bleed into one another. Similarly, by treating fibers to have an increased anionic charge, the fibers will resist cross-staining while they are being manufactured and heavily processed. The other benefits including comfort, softness, appearance, and aesthetic improvements are difficult to quantify, but are nonetheless important to the present invention.

In one particular application, the white pocket fibers and the undyed fill yarn in denim garments may be treated in accordance with the present invention so that they are not as stained by indigo dyes or other dark dyes present in the garments. As discussed above, in the past, garment manufacturers have had problems in keeping pocket liners white for the life of the garment, since such liners are typically made from undyed cotton fibers and blends which are easily cross stained. By treating pocket liners in accordance with the present invention, the pockets of a garment remain whiter even after repeated launderings, which greatly enhances the visual appeal of the garments.

The process of anionically treating cellulosic fibers in accordance with the present invention may also be applied to fibers and yarns used in carpeting. In particular, the process of the present invention is particularly well-suited for use with carpet materials made with cotton fibers. The treatment renders the carpet fibers extremely stain resistant to anionic compounds, dyes, and other coloring or staining agents. Charge repulsion results in greater loft and hence coverage.

Besides increasing the stain resistance of textile products containing cellulosic fibers, such as cotton fibers, the process of the present invention also produces other advantages. For instance, once treated in accordance with the present invention, garments have an increased attraction to cationic fabric softeners and bacteriocides, which may be used to treat the garments either during manufacturing or during regular laundering in the rinse cycle or in the dryer. Specifically, most fabric softeners and bacteriocides are cationically charged. Thus, by increasing the anionic character of fibers present in garments, a greater attraction is produced between the garments and the fabric softeners and bacteriocides. The levels of these ingredients can be controlled at higher levels. In addition, the softeners have improved resistance to laundering and lubricate the yarns to protect the garment from wear caused by abrasion.

As described above, the present invention is generally directed to a process for increasing the anionic character of cellulosic fibers in order to prevent cross-staining. Many different processes can be used to increase the anionic character of cellulosic fibers in accordance with the present invention. In the past, others have proposed various methods for increasing the anionic charge of cellulosic materials. As opposed to the present invention, however, these processes were not used for preventing cross-staining, but, instead, were used for other purposes.

In one embodiment of the present invention, the anionic character of cellulosic fibers is increased through a sulfation or sulfonation process. A variety of reagents are suitable for use in these processes.

For instance, sulfamic acid, a reagent normally found in powder form, can be used to achieve sulfation of cellulosic fibers. However, the use of sulfamic acid may lead to hydrolysis and yellowing of the fabric. Consequently, a neutral pH sulfamate is initially contacted with the fabric or fibers in order to protect the fabric or fibers from hydrolysis and yellowing. For example, in one embodiment of the present invention, the reaction product of sulfamic acid and a volatile amine is used. Thus far, such a reaction product has proved to be an effective and inexpensive sulfating agent for cellulosic fibers such as cotton fibers. However, it requires a relatively higher temperature to effect an adequate level of care.

As used herein, a volatile amine refers to an amine that will evaporate when the fabric is later cured. Examples of volatile amines that may be used in the present invention include methyl amine, ethyl amine, ammonia, and the like including mixtures of the above as well.

In one embodiment, ammonium sulfamate is used. The ammonium ion easily reverts to volatile ammonia when heated. Thus, the sulfating agent sulfamic acid is regenerated under mild conditions of minimal acidity to protect the cotton from hydrolysis.

In one embodiment of the present invention, when treating fibers and fabrics, the reaction product of sulfamic acid and a volatile amine can be added to an aqueous solution at a concentration of at least 20 grams per liter. For instance, in one embodiment, ammonium sulfamate is added to an aqueous solution at a concentration of 5–40 g/L and particularly at a concentration of 10–20 g/L. The concentration of course depends on the wet pick-up during application. Thus far, it has been found that adding over 40 g/L of the ammonium sulfamate to the aqueous solution adds no further benefit to the anionic treatment of the cellulosic fibers. In fact, the addition of too much ammonium sulfamate to the solution may start to induce excessive yellowing of the fibers and weaken the fibers.

In order for the above stated sulfation process to occur properly and to enable the cellulosic fibers to be anionically treated for resistance to cross-staining, urea, which may act as a co-reactant, can be introduced into the aqueous solution being prepared for the treatment. In addition, adding urea prevents yellowing of the fibers and protects the fibers during heat treatment. Urea can be added at a concentration from about 25 g/L up to about 100 g/L. In one embodiment, urea is added to the aqueous solution at a concentration of 25–75 g/L. Thus far, it has been found that using over 100 g/L of urea adds no further benefits to the cellulosic fibers when the urea and sulfamate ingredients are added separately to the formulation.

In general, a higher concentration of urea (50–75 g/L) should be used for certain cellulosic fibers such as 100% blended mercerized cotton fibers while a lower concentration of urea (30–50 g/L) can be used for other cellulosic fibers such as unmercerized cotton fibers. All of these recommendations apply to the case where urea and sulfamate are simply mixed together and not pre-formed into a complex.

Besides the derivatizing agent and urea, various other additives and ingredients may be included in the composition as desired. For instance, various additives can be included for either improving the process or for improving the final product. For example, in one embodiment, sodium borate ($Na_2B_4O_7$) can be added. In particular, it has been discovered that sodium borate in small amounts is beneficial in further preventing yellowing of the fibers. For instance, sodium borate can be added to the composition in an amount up to about 8 g/L, and particularly in an amount from about 2 g/L to about 3 g/L.

In another embodiment of the present invention, ammonium phosphate may be incorporated into the aqueous solution in addition to urea. This component can be added at a concentration of approximately 5 g/L to replace 25 g/L of urea and maintain the same performance. The purpose of adding the ammonium phosphate is to act as a catalyst for the other reactants.

In another embodiment of the present invention, besides using a sulfamate, derivatising the cellulosic fibers is carried out by using the reaction product of epichlorohydrin and sodium bisulfite. The reaction product in this embodiment is a glycidyl sulfonate salt, which has the capability to act as a sulfonating agent unlike ammonium sulfamate which is a sulfating agent.

Various embodiments of a process for derivatising cellulosic fibers, particularly cotton fibers, in accordance with the present invention will now be described. In one embodiment, sulfation of the fibers is carried out using sulfating or sulfonating agents, such as ammonium sulfamate or sulfamic acid, in combination with urea. However, it was discovered that pre-generating the complex between urea and sulfamic acid improved the performance of this mixture. It should be understood, however, that various other sulfating or sulfonating agents may be used in accordance with the present invention in addition to other anionic modifying reagents and that the following description is for exemplary purposes only. In particular, it should be understood that the following concentration ranges and parameters can widely vary depending upon the particular application. For instance, such concentrations and parameters can change when treating carpet materials.

One embodiment of a process for anionically treating cellulosic fibers in order to render them resistant to cross-staining begins with adding the cellulosic fibers or fabrics to a solution bath. This aqueous solution bath can contain ammonium sulfamate and urea at concentrations of 5–20 g/L and 25–75 g/L respectively and can be at a temperature of from 60 to 90° F.

Well-prepared cellulosic fibers or fabrics are then contacted or padded with the aqueous solution for a short time. Such fibers require only a brief period of contact with the aqueous solution because of the high wet pick-up values (50–80% weight). After the fibers are contacted with the aqueous solution bath, the excess water and solution are abstracted by squeezing out the fibers or fabric.

The fibers are then dried at a temperature of from 150–200° F. for 1–2 minutes. Next, the fibers are cured at a higher temperature (from 280–325° F.) in order for the sulfation reaction to go to completion. During this heat treatment, the ammonia is volatilized and given off. Also during heat treatment, the sulfate ions that were released from the ammonium sulfamate reaction become bound to the cellulosic fibers, increasing the anionic character of the fibers.

The heat curing process can typically last up to approximately 5–10 minutes. This depends on the fabric construction and weight and in some cases "flash curing" at 400° F.–425° F. is sufficient (which can last for only a few seconds). The fibers are then rinsed at a temperature of about 100° F. for 2 minutes and are neutralized with a sodium carbonate solution for 3–4 minutes. At the completion of this process, the anionic charge of the cellulosic fibers becomes permanently increased.

In addition to the embodiments described above, another improved embodiment of a process for derivatising cellulosic fibers, particularly cotton fibers, in accordance with the present invention includes the use of an aqueous solution of a preformed complex of a derivatising agent to anionically treat the fibers. This complex will afford the same result as before but at much lower cure temperatures.

The present inventors discovered that a complex formed from a derivatising agent can provide various benefits and advantages unknown in the prior art. For instance, the use of a pre-formed complex can allow curing at lower temperatures, thereby aiding in the efficiency of the overall process. In particular, lower curing temperatures can be realized with a pre-formed complex because the complex can form anions on cellulosic fibers at much lower temperatures than a simple mixture. Thus far, for instance, it has been found that the complex can be applied to cotton at a temperature as low as 240° F., and particularly from about 240° F. to about 300° F.

In accordance with the present invention, one embodiment of a process for anionically treating cellulosic fibers using a pre-formed complex made from a derivatising agent in order to render the fibers resistant to cross-staining is described below. In particular, one embodiment of the present invention includes a pre-formed sulfamic acid complex to treat a cotton fabric. It should be understood, however, that various other sulfating or sulfonating agents may be used in accordance with the present invention in addition to other anionic modifying reagents and that the following description is for exemplary purposes only. In particular, it should be understood that the following concentration ranges and parameters can widely vary depending upon the particular application. For instance, such concentrations and parameters can change when treating carpet materials.

In general, a complex of the present invention is formed by mixing sulfamic acid with an amide of a carboxylic acid, such as urea. For instance, sulfamic acid can be mixed with excess urea in a mole ratio, of from about 1:3 to about 1:12 moles sulfamic acid to moles urea, and particularly from about 1 mole sulfamic acid to about 6 moles urea. The mixture is heated to 130° F., without agitation, in the presence of a small amount of a catalyst, such as phosphoric acid, until the entire mass completely melts. Once the mass melts, it is thereafter mixed until a complex forms. The resulting complex can then be diluted with water. In one embodiment, phosphoric acid remains present in the form of ammonium phosphate in an amount of about 0.2 moles for every 1.0 mole of urea.

After the complex is formed, it is then applied to the cellulosic fibers or fabric, dried, cured and rinsed as described in the embodiments above. When curing a fabric treated with a complex of the present invention at higher temperatures, misting or smoking can often occur. For example, when a fabric treated with a urea-sulfamic acid complex is cured at temperatures of about 340° F. or higher, a mist can result.

Such misting, often called "smoking", typically occurs when organic mixtures that are partially soluble in water are heated so as to steam distill in the presence of boiling water. The low molecular-weight fractions of these mixtures, when deposited onto a fabric as part of a water solution, can be steam-stripped from the fabrics by the last remaining traces of water as the fabric is heated to dryness. Steam-stripping can disperse the organic particles into the atmosphere where they can then re-condense. These re-condensed particles form a visible mist.

In this regard, when urea-sulfamic acid complexes of the present invention are heated to higher temperatures, urea can be steam-stripped from the fabric to form a visible mist. Accordingly, to prevent such misting, additional amounts of ammonium sulfamate can be applied to compensate for any free urea present within the complex. It has been discovered that when additional ammonium sulfamate is added to the performed complex of the present invention, a non-volatile salt can form without any noticeable free urea mist. The salt effectively prevents misting by complexing the free urea. Moreover, both the urea and sulfamic acid within the salt remain fully functional in the anionic-generating process.

The amount of ammonium sulfamate added to the complex will generally depend upon the amount of free urea present within the complex. For most applications, less than a stoicheometric amount of ammonium sulfamate can be added to the complex in comparison to the amount of free urea. The ammonium sulfamate can be added as ammonium sulfamate or, alternatively, ammonia and sulfamic acid can be added separately. In one embodiment, ammonium sulfamate can be added in an amount such that the sulfamic acid present in the ammonium sulfamate is equivalent to the amount of sulfamic acid used to initially create the complex.

During the process of the present invention, only minor amounts of anionic ions need be attached to the cellulosic material in order to achieve the benefits and advantages of the present invention. For instance, the amount of sulfur attached to the cellulosic material during the process can be less than 0.5% by weight, particularly less than 0.05% by weight, and more particularly less than 0.005% by weight. Even at these small concentrations, it has been discovered that cotton materials will repel anionic agents and will attract cationic agents, such as softeners and bacteriocides.

As described above, the processes of the present invention permanently increase the anionic character of cellulosic fibers and fabrics in order to make textile articles resistant to cross-staining. For some applications, the fibers should be treated according to the present invention after a fabric or garment is formed, and preferably after the fabric or garment has been dyed. As such, the present invention can be viewed as a post-treatment process for post-treating formed fabrics and/or garments.

In alternative embodiments, however, the cotton fibers can be derivatised according to the present invention at other stages during the fabrication of the particular textile article. For most garments, such as shirts, blouses and the like, the anionic treatment takes place on the formed fabric before the fabric is cut and sewn into a particular item. In particular, preferably the fabric is treated after being dyed. For white garments, such as white shirts, the anionic treatment is carried out after the fabric has been bleached and treated with a colorless dye such as an optical brightener.

As stated above, the anionic treatment of the present invention is particularly designed for light or white colored fabrics, where cross-staining creates more of a potential problem. In fabrics and garments containing light colored areas and dark colored areas, such as striped or patterned fabrics, in one embodiment, the light colored areas can be treated according to the present invention by treating the yarn that is used to form those areas. Preferably the anionic treatment is carried out after the yarn has been dyed. For example, for denim fabrics and garments, preferably the white fill yarn is treated prior to being incorporated into the denim fabric. Alternatively, the fiber itself can be treated prior to being formed into the yarn.

Other garments that are particularly well suited for use in the process of the present invention include socks and other hosiery, pocket liners, and various undergarments. With respect to pocket liners, preferably the fabric that is used to make the pocket liners is treated prior to being incorporated into a garment. With respect to socks and undergarments, however, the yarn, the fabric or the completed product itself can be treated according to the present invention.

As described above, in addition to preventing cross-staining, the anionic treatment can also be used to facilitate application of softeners and bacteriocides. In general, the softeners and bacteriocides can be applied to the cellulosic materials after the derivatising agent has been applied.

Softeners that can be used in this regard include preferably cationic softeners or softeners contained within a cationic solution. By increasing the degree of anionicity of the cellulosic material according to the process of the present invention, it has been discovered that there is an increase in the rate of exhaustion and an increase in the amount of softener absorbed onto the surface of the material.

In the garment industry, there is great interest in producing garments with unique hand. Of particular interest is a hand that is very soft and buttery that gives cotton better drape. Normally, this is achieved with high levels of fatty and silicone derivatives and combinations. However, it is usually difficult to obtain a soft drape with softener alone. These disadvantages and drawbacks, however, have been overcome according to the process of the present invention.

Particular softeners that can be used according to the present invention include siloxanes such as aminosiloxanes, fatty amines, quaternary amines such as fatty quaternary amines, polysilicones and other silicones. For example, particular softeners that can be used in the present invention include BLUE-J ULTRALUX, which is a silicon fluid emulsified with non-ionic emulsifiers and is marketed by Sybron Chemicals, Inc. of Wellford, S.C. Another softener that may be used is TANASOFT HCA, which is a fatty amide and which is also marketed by Sybron Chemicals, Inc. Organomodified polydimethylsilicones that may be used include SILQUAT AT 5–52 and SILQUAT AT 5–49, both marketed by Silatech Corporation of Toronto, Ontario. Still another softener that may be used is KELMAR 1964, which is a silicone fluid and which is marketed by Kelmar Industries of Duncan, S.C.

Prior to being applied to cellulosic materials, such as cotton, in accordance with the present invention, the above softeners can be first combined with various other ingredients. For instance, in most applications, the softener will be combined in a solution or bath and applied to the cellulosic material. The bath can contain water, emulsifiers, and other solvents, such as alcohols. For instance, the above described organomodified polydimethylsilicones are typically combined with isopropyl alcohol prior to being applied to cellulosic materials.

In one preferred embodiment of the present invention, the softener composition selected is combined with one or more emulsifiers. It is believed that using particular emulsifiers, such as cationic or nonionic emulsifiers, facilitates application of the softener to cellulosic materials. Various emulsifiers that can be used include siloxane emulsifiers, such as amino siloxane emulsifiers (which can also be linear), quaternary amines such as fatty quaternary amines, soya amine quaternaries such as ethoxylated soya amine quaternaries, and ethoxylated alcohols. In one embodiment, the ethoxylated alcohol can include 6 moles of ethoxylate and wherein the alcohol has from about 9 to 11 carbon atoms in its chain. The emulsifiers can be combined with a softener in an amount from about 10% to about 50% by weight, and particularly from about 25% to about 45% by weight.

The softener solution can be applied to derivatised cellulosic materials in any suitable manner, such as spraying, dipping, or foaming. In one embodiment, the softener can be combined in a bath into which a fabric derivatised in accordance with the present invention is submerged. The bath can contain the softener in an amount up to about 50% by weight, particularly from about 1% to about 10% by weight, and more particularly in an amount from about 4% to about 6% by weight.

The bath can be maintained at room temperature or can be heated slightly, such as from a temperature of from about 80° F. to about 150° F. The pH of the bath will depend upon the particular circumstances. For most applications, however, the pH of the bath should be less 7.0, such as from about 4.5 to about 5.5. The derivatised cellulosic material can be submerged in the bath for a time sufficient for the softener to become bound to the material. For instance, the cellulosic materials can be placed in the bath for a time of from about 1 minute to about 20 minutes, and particularly from about 8 minutes to about 12 minutes.

Once the cellulosic materials are removed from the bath, the materials are dried and used as desired. In one embodiment, the materials can be dried at a temperature of from about 150° F. to about 210° F., and particularly from about 170° F. to about 190° F. for from about 20 minutes to about 60 minutes.

Besides fabrics and garments, however, the process can be used to treat fibers in other applications as well. For instance, as described above, the process of the present invention can be used to treat carpet materials, especially carpet materials containing cotton fibers, in order to increase the resistivity of the materials to staining by anionic agents, especially the red dye employed in the so-called cherry "Kool-Aid" stain blocking test.

Textile products treated in accordance with the present invention have shown to be successfully resistant to cross-staining by anionic dyes. In particular, textile articles treated in accordance with the present invention are capable of resisting being stained when placed in a bath containing a cotton swatch dyed with 2% DR-79 red dye or 2% DBL-80 blue dye, which are commonly used anionic dyes, washed at 120° F. according to AATCC IIA wash test specifications, rinsed clear and dried. Specifically, fabric swatches treated according to the present invention have been shown to have an AATCC gray scale rating of 4 to 5 after being contacted with the dyes as described above.

AATCC test method 61-1975, which includes reference to test IIA, is as follows:

1. Purposes and Scope 1.1 These accelerated laundering tests are designed for evaluating the washfastness of textiles which are expected to withstand frequent laundering. The color loss and abrasive action of five average hand, commercial, or home launderings with or without chlorine, are closely approximated by one 45-minute test. However, the staining effect produced by five average hand, commercial, or home launderings cannot always be predicted by the 45-minute test. Staining is a function of the ratio of colored fabrics in the wash load and other end use conditions which are not always predictable.

2. Principle 2.1 Specimens are laundered under the appropriate conditions of temperature, bleaching and abrasive action such that the desired loss of color is obtained in a conveniently short time. The abrasive action is accomplished by the use of throw, slide, and impact, together with the use of a low liquor ratio and an appropriate number of steel balls 3. Apparatus and Materials 3.1 Laundering-Ometer or similar apparatus for rotating closed containers in a thermostatically controlled water bath at 42 rpm 3.2 Stainless steel cylinders, 9×20 cm (3 ½×8 in)

3.3 Adapter plates (for holding 9×20 cm (3 ½×8 in.) cylinders on Launder-Ometer shaft)

3.4 Stainless steel balls 3.5 Flatiron 3.6 Multifiber test fabric No. 10

3.7 Cotton fabric 80×80, bleached, desized 3.8 AATCC Standard Detergent WOB (without optical brightener)

3.9 AATCC Standard Detergent 124 (contains optical brightener)

3.10 Acetic acid, 28%

3.11 Water, distilled 3.12 Sodium hypochlorite 3.13 AATCC Chromatic Transference Scale 3.14 Gray Scale for color Change 3.15 Gray Scale for Staining 4. Test Specimens 4.1 The size of the specimens required for the test is as follows:

5×15 cm (2×6 in.)

4.2 One specimen is needed for each container 4.3 To determine staining multifiber test fabric should be used.

4.4 Prepare pieces with a 5 cm (2 in.) square of multifiber cloth sewed or stapled along one 5 cm (2 in.) edge of the test specimens and in contact with the face of the material. Attach so that each of the 6 fiber stripes along the 5 cm (2 in.) edge of the specimen. It is recommended that knitted fabrics be sewn or stapled at the four edges to equivalent size pieces of 80×80 bleached cotton fabric to avoid rolled edges and to assist in obtaining a uniform test result over the entire surface.

5. Procedure 5.1 Table I summarizes the conditions of the test.

TABLE I

| Test Conditions | | | | | | |
|---|---|---|---|---|---|---|
| Temp. | | Total Liquor Volume | % Detergent of Total | % Available Chlorine of Total | Steel Balls | Time in |
| F | C | in ml | Volume | Volume | (#) | Min. |
| 120 | 49 | 150 | 0.2 | None | 50 | 45 |

5.2 Adjust the Launder-Ometer to maintain the designated bath temperature. Prepare the required volume of wash liquor. Preheat this solution to the prescribed temperature.

5.3 The tests are run in 9×20 cm (3 ½×8 in.) stainless steel cylinders.

5.3.1 Place in the cylinder the amount of detergent solution as designated in Table 1.

5.3.2 Add the designated number of stainless steel balls to each container and clamp the cover. Fasten the 9×20 cm (3 ½×8 in.) containers horizontally in the adapters on the rotor of the Launder-Ometer in such a manner that when the containers rotate, the covers strike the wafer first. They are also arranged so that an equal number of containers is on each side of the shaft.

5.4 Start the rotor and run for not less then two minutes to preheat the containers.

5.5 Stop the rotor and with a row of containers in an upright position, unclamp the cover of one container, enter a well-crumpled test specimen into the solution and replace the cover, but do not clamp it. Repeat this operation until all the containers in the row have been loaded (cover clamping is delayed to allow equalization of pressure). Start the Launder-Ometer and run at 42 rpm for 45 minutes.

5.6 The rinsing, souring extraction, and drying methods are the same for all the tests. Stop the machine, remove the containers and empty the contents. Rinse each test specimen twice, in beakers, in fresh 100-ml baths of water at 40° C. (150° F.) for one-minute periods with occasional stirring or hand squeezing. Sour in 100 ml of a 0.014% solution of acetic acid (0.05 ml of 28% acetic acid per 100 ml of water) for one minute at 27° C. (80° F.). rinse again for one minute in 100 ml water at 27° C. (80° F.). Hydroextract or pass the test specimens between wringer rolls to remove excess moisture. Dry by pressing with an iron (135° C.–150° C.) (275°–300° F.) with the fabric uppermost and in contact with the face of the test specimen.

6. Interpretation of Results 6.1 The conditions in these tests give results which correlate with the results of five average home or commercial launderings. These are accelerated tests, and in obtaining the required degree of acceleration some of the conditions, such as temperature, were purposely exaggerated. These tests are satisfactory consumer end-use tests, and the correlation with average laundry practice is given in the following section on Evaluation.

7. Evaluation 7.1 This test is designated for evaluating the washfastness of fabrics that are expected to withstand repeated low-temperature machine washing in the home or in the commercial laundry. Specimens subjected to this test should show color damage similar to that produced by five commercial launderings at 38° C. (100° F.) or by five home machine launderings at medium or warm setting in the temperature range of 38° C. (100° F.).

8. Evaluation Method for Staining 8.1 Staining can be evaluated by means of the AATCC Chromatic Transference Scale or the Gray Scale for Staining. The means should be indicated when reporting the test results.

Class 5—negligible or no staining.

Class 4—staining equivalent to Row 4 on the AATCC Scale or Step 4 on the Staining Scale.

Class 3—staining equivalent to Row 3 on the AATCC Scale or Step 3 on the Staining Scale.

Class 2—staining equivalent to Row 2 on the AATCC Scale or Step 2 on the Staining Scale.

Class 1—staining equivalent to Row 1 on the AATCC Scale or Step 1 on the Staining Scale.

Because of the use of sulfamate in the application of the resins, the anionic character of the fibers is also increased. Thus, the fibers become both wrinkle and stain resistant.

EXAMPLES

Several tests were performed on anionically treated cellulosic fibers and fabrics produced according to the present invention in order to demonstrate the fabrics' increased resistance to cross-staining by heavily dyed fabrics. Routine test methodology was employed in testing these fabrics and fibers, and data was collected in order to quantitatively illustrate the increased resistance to cross-staining that results from the anionic treatment of cellulosic fibers and fabrics.

Example 1

In this example, a wash test, the AATCC IIA Wash Test, was performed on several different samples of 100% bleached mercerized cotton fabric. Most of the samples were anionically treated in accordance with the present invention, while one sample was untreated. The wash test was first done using fabric dyed with 2% Direct Red (DR) 79 as a source of unfixed dye that would readily cross stain on to light-colored or white fabrics if those fabrics were untreated.

The fabric samples that had been treated according to the present invention with an anionic treatment process were padded with an aqueous solution, dried, cured, rinsed, and neutralized before being tested. The aqueous solution contained ammonium sulfamate and urea. The amounts of both the ammonium sulfamate and the urea were altered until the least amount of cross-staining occurred. The following results were obtained:

TABLE 1

| AATCC-Grey Scale Ratings Fabric 100% Bleached Merc. Cotton | | |
|---|---|---|
| | Dyed Portion of Test Fabric | |
| Undyed Portion of Test Fabric | 2% Dir. Red 79 Stain on Undyed Cotton | 2% Dir. Blue 80 Stain on Undyed Cotton |
| Original-No Treatment | 1 | 1 |
| 25 Gr/L ammonium | 3 | 3 |

TABLE 1-continued

| AATCC-Grey Scale Ratings Fabric 100% Bleached Merc. Cotton | | |
|---|---|---|
| | Dyed Portion of Test Fabric | |
| Undyed Portion of Test Fabric | 2% Dir. Red 79 Stain on Undyed Cotton | 2% Dir. Blue 80 Stain on Undyed Cotton |
| sulfamate solution* 50 Gr/L Urea | | |
| 30 Gr/L ammonium sulfamate solution* 50 Gr/L Urea | 3–4 | 3–4 |
| 25 Gr/L ammonium sulfamate solution* No Urea | 2–3 | 2–3 |
| 30 Gr/L ammonium sulfamate solution* 75 Gr/L Urea | 4 | 4 |
| 40 Gr/L ammonium sulfamate solution* 50 Gr/L Urea | 4 | 4 |
| 40 Gr/L ammonium sulfamate solution* 75 Gr/L Urea | 4–5 | 4–5 |
| 1 = Heavy Stain 5 = No Stain | | |

*Aqueous solution containing 47.0% ammonium sulfamate

As shown above, the untreated sample was heavily cross-stained to a dark pink color during the test. Fabrics treated according to the present invention, however, were stained much less. The fabric sample that exhibited the least amount of cross-staining was treated with 40 g/L of ammonium sulfamate solution and 75 g/L of urea. One fabric sample was tested after being treated with 25 g/L of ammonium sulfamate solution and no urea. This fabric sample showed significantly more cross-staining than did the sample treated with 25 g/L of ammonium sulfamate solution and 50 g/L of urea. This fabric sample also appeared slightly yellowed or discolored in spots indicating that hydrolysis of the cellulosic fibers may have taken place.

As shown in the table above, the same sequence of tests were performed using fabric dyed with 2% Direct Blue (DBl) 80 as the source of unfixed dye. Similar results were obtained. The fabric sample treated with 40 g/L of ammonium sulfamate solution and 75 g/L of urea exhibited the least amount of cross-staining. Thus, the results of the above example demonstrate both the importance of using urea as a catalyst in the treatment process and the excellent performance of the fabrics in resistance to cross-staining.

Example 2

In this example, the wash test used in Example 1, AATCC Wash Test Method 61-1994 Rectrin 2A, was performed on samples of 100% bleached unmercerized cotton fabric. Again, fabric dyed with 2% DR 79 and 2% DBl 80 were used as the sources of unfixed dye in order to facilitate possible cross-staining on to the fabric samples being tested. The following results were obtained:

TABLE 2

| AATCC-Grey Scale Ratings Fabric 100% Bleached Unmercerized Cotton | | |
|---|---|---|
| | Dyed Portion of Test Fabric | |
| Undyed Portion of Test Fabric | 2% Dir. Red 79 Stain on Undyed Cotton | 2% Dir. Blue 80 Stain on Undyed Cotton |
| Original-No Treatment | 2 | 2 |
| 25 Gr/L ammonium sulfamate solution* 50 Gr/L Urea | 5 | 5 |
| 30 Gr/L ammonium sulfamate solution* 50 Gr/L Urea | 5 | 5 |
| 25 Gr/L ammonium sulfamate solution* No Urea | 4 | 4-5 |
| 1 = Heavy Stain 5 = No Stain | | |

*Aqueous solution containing 47.0% ammonium sulfamate

Similar to the previous example, fabric samples that were not treated by the anionic treatment process were tested and showed some cross-staining, while samples treated according to the present invention exhibited much less staining. The samples treated with 30 g/L of ammonium sulfamate solution and 50 g/L of urea showed absolutely no cross-staining when tested with the dyed fabrics. Other samples of bleached unmercerized cotton fabric that were treated with 25 g/L of ammonium sulfamate solution and no urea did exhibit some cross-staining.

These results further illustrate the benefits of using urea in the treatment process. In addition, since all cross-staining was eliminated with the use of just 30 g/L of ammonium sulfamate solution and 50 g/L of urea in this example, it is evident that unmercerized cotton fabrics require less negative charge than mercerized cotton because of the inherent lower receptivity to anionic dyes of unmercerized cotton. In the previous example, 40 g/L of ammonium sulfamate solution and 75 g/L of urea were required to produce a fabric with the least amount of cross-staining. However, the cross-staining was not completely eliminated as it was for the unmercerized samples. This result is fitting with anticipated results since mercerized fabrics have increased affinity for dyes (as well as increased luster). This increased affinity for dyes is attained through the mercerization process during which fabrics are immersed in cold basic solutions of sodium hydroxide and are later neutralized in acid.

Example 3

In this example, equal weights of a fabric dyed with 2% DR 79 and either an anionically treated or an untreated bleached mercerized cotton fabric were soaked together for 5 minutes at 100–120° F. at a 15:1 liquor ratio or ratio of weight of liquid used to weight of goods treated. The fabrics were then rinsed at room temperature and dried. These test conditions were established in order to resemble the pre-wash stage of an actual washing machine situation. The amounts of ammonium sulfamate and urea used were varied, and fabric samples were observed at several different processing stages including immediately after the rinsing and neutralization steps of the anionic treatment, after 1 pre-wash sitting as described above, and after 5 pre-wash sittings. A sample of untreated fabric exhibited some cross-staining in that it turned a light pink color. However, all of the treated fabric samples tested at each of the various observation stages and with each of the various amounts of ammonium sulfamate and urea showed absolutely no cross-staining. By looking at this example, it can be seen that under pre-wash conditions, the anionic treatment process successfully eliminates cross-staining of dark-colored dyes on to white or light-colored mercerized cotton fabrics.

Example 4

The same stain testing procedure used in Example 3 was employed in the present example; however, bleached unmercerized cotton fabric samples were tested. The sample of fabric untreated by the anionic treatment process exhibited just a small amount of cross-staining in that the fabric had an extremely faint pink tint. Yet, the anionically treated samples of unmercerized cotton fabric showed absolutely no cross-staining no matter the observation stage or the proportions of the reagents. Therefore, similar to Example 3, the anionic treatment process is seen to be successful in eliminating cross-staining on to unmercerized cotton fabrics under pre-wash conditions. Again, the unmercerized fabric samples proved to be more resistant to cross-staining than the mercerized fabric samples. This is consistent with the results found in Examples 1 and 2.

Example 5

In this example, tests were performed on fabric samples in order to demonstrate the permanence or durability of the anionic treatment. Anionically treated and untreated samples of 100% bleached mercerized cotton fabric were pre-washed 5 times in normal household detergent and under normal household laundering conditions with a hot washing period and a warm rinsing period. These samples were then subjected to AATCC 2A wash test conditions as stated in Example 2. The following results were obtained:

TABLE 3

| AATCC-Grey Scale Ratings Fabric 100% Bleached Merc. Cotton | | |
|---|---|---|
| | Dyed Portion of Test Fabric | |
| Undyed Portion of Test Fabric | 2% Dir. Red 79 Stain on Undyed Cotton | 2% Dir. Blue 80 Stain on Undyed Cotton |
| Original-No Treatment | 1 | 1 |
| 25 Gr/L ammonium sulfamate solution* 50 Gr/L Urea | 3 | 3 |
| 30 Gr/L ammonium sulfamate solution* 50 Gr/L Urea | 3-4 | 3-4 |
| 25 Gr/L ammonium sulfamate solution* No Urea | 2-3 | 2-3 |
| 30 Gr/L ammonium sulfamate solution* 75 Gr/L Urea | 4 | 4 |
| 40 Gr/L ammonium sulfamate solution* 50 Gr/L Urea | 4 | 4 |
| 40 Gr/L ammonium sulfamate solution* 75 Gr/L Urea | 4 | 4-5 |
| 1 = Heavy Stain 5 = No Stain | | |

*Aqueous solution containing 47.0% ammonium sulfamate

The sample of mercerized fabric that had not been anionically treated exhibited significant cross-staining. Yet, the samples of fabric that had been treated with 40 g/L of ammonium sulfamate solution and 75 g/L of urea displayed the least amount of cross-staining. Furthermore, the samples treated with 25 g/L of ammonium sulfamate solution and no urea showed significant cross-staining as well as slight yellowing. Therefore, the value of using urea as a catalyst in the treatment process is again illustrated. In addition, the effects of the anionic treatment process are shown to be permanent as seen with the fabric samples whose resistance to cross-staining after 5 pre-washes was just as strong as it was prior to being pre-washed.

Example 6

The same procedures used for testing the durability and permanence of the anionic treatment process in Example 5 were employed in this example except that samples of 100% bleached unmercerized cotton fabric were tested. The following results were obtained:

TABLE 4

| AATCC-Grey Scale Ratings Fabric 100% Bleached Unmercerized Cotton | | |
|---|---|---|
| | Dyed Portion of Test Fabric | |
| Undyed Portion of Test Fabric | 2% Dir. Red 79 Stain on Undyed Cotton | 2% Dir. Blue 80 Stain on Undyed Cotton |
| Original-No Treatment | 2 | 2 |
| 25 Gr/L ammonium sulfamate solution* 50 Gr/L Urea | 5–4 | 5 |
| 30 Gr/L ammonium sulfamate solution* 50 Gr/L Urea | 5–4 | 5 |
| 25 Gr/L ammonium sulfamate solution* No Urea | 4–5 | 4–5 |
| 1 = Heavy Stain 5 = No Stain | | |

*Aqueous solution containing 47.0% ammonium sulfamate

The fabric samples treated with 30 g/L of ammonium sulfamate solution and 50 g/L of urea exhibited absolutely no cross-staining. However, samples treated with 25 g/L ammonium sulfamate solution and no urea did show some cross-staining. Therefore, comparable to Example 5, the importance of using urea as a catalyst as well as the permanence and durability of the anionic treatment process are shown. These samples of unmercerized cotton fabric also proved to be more readily treated for cross stain resistance than the samples of mercerized cotton tested in Example 5.

Example 7

The tests in this example were performed in order to further determine the effects of varying the concentration of urea in catalyzing the anionic treatment process described in the present invention. Samples of 100% bleached mercerized cotton fabric were tested after being padded with the aqueous treatment solution, dried, and cured at 300° F. The source of unfixed dye used was fabric dyed with 2% DBl 80. The concentration of ammonium sulfamate solution (47.0% solution) incorporated into the aqueous treatment solution was held constant at 25 g/L while the concentration of urea was varied from 2.5 g/L up to 100 g/L. The following results were obtained:

TABLE 5

AATCC-Grey Scale Ratings
Fabric 100% Bleached Merc. Cotton

| Undyed Portion of Test Fabric | Dyed -Portion of Test Fabric 2% Dir Blue 80 Stain on Undyed Cotton |
|---|---|
| 25 Gr/L ammonium sulfamate solution* 25 Gr/L Urea | 2–3 |
| 25 Gr/L ammonium sulfamate solution* 5 Gr/L Urea | 3 |
| 25 Gr/L ammonium sulfamate solution* 10 Gr/L Urea | 3 |
| 25 Gr/L ammonium sulfamate solution* 15 Gr/L Urea: | 3 |
| 25 Gr/L ammonium sulfamate solution* 20 Gr/L Urea | 3 |
| 25 Gr/L ammonium sulfamate solution* 25 Gr/L Urea | 3–4 |
| 25 Gr/L ammonium sulfamate solution* 30 Gr/L Urea | 3–4 |
| 25 Gr/L ammonium sulfamate solution* 40 Gr/L Urea. | 4 |
| 25 Gr/L ammonium sulfamate solution* 50 Gr/L Urea | 4–5 |
| 25 Gr/L ammonium sulfamate solution* 75 Gr/L Urea | 4–5 |
| 25 Gr/L ammonium sulfamate solution* 100 Gr/L Urea | |
| Original-No Treatment 1 = Heavy Stain 5 = No Stain | 1 |

*Aqueous solution containing 47.0% ammonium sulfamate

The fabric sample treated with 75 g/L of urea (along with the 25 g/L of ammonium sulfamate solution) exhibited the least amount of cross-staining. This shows that using 100 g/L of urea in the treatment solution is above the level needed in this embodiment and that 75 g/L of urea is the optimum concentration for applying excellent cross stain resistance to this mercerized cotton fabrics.

Example 8

This example demonstrates the general nature of the concept that creating additional anionic groups on cellulose alters some of the basic characteristics of cotton fabric. The previous examples examined the effect on dye uptake. Here, the effect on one of the performance properties, smoothness (or resistance to laundry wrinkles) is investigated. Additionally, the anionic groups were generated by an alternate chemistry to the sulfamate that has been discussed.

Comparisons were made of fabrics that had been treated with chloroacetic acid to fabrics that had been treated with a standard cellulosic crosslinking chemistry which is composed of DMDHEU resin and catalyst. The treatment procedures of the solutions that were applied to the fabric are summarized in Table 6.

Included in Table 6 are the smoothness ratings that were determined by comparisons to the AATCC series of Three Dimensional Durable press Rating Replicas (used with AATCC standard test method 124). Under this type of rating system, rating 1 is the worst, the most wrinkled, and rating 5 is the best, or least wrinkled.

The fabric in all cases is 100% cotton bleached "80 square" cotton cut into 15 in. by 15 in. sections. In each run, the solutions were made at ambient temperature by adding the components to the water in the order shown in Table 6.

Run 1)

1) Pad at room temperature to a wet pick-up of 70%

2) Dry at 140° F.–160° F. for 2 minutes

3) Cure at 300° F. for 5 minutes

4) Wash and dry as per AATCC test method 124–1989

5) Evaluate smoothness as per AATCC test method 124

Run 2) (As per Procedure 1 except that step 3 is to cure for 3 minutes at 325° F.)

Run 3–Run 5)

(as in Run 1)

TABLE 6

(Chemical compositions of the solutions used in the various runs. Amounts are in % on the weight of the fabric.)

| Chemical | Run 1 | Run 2 | Run 3 | Run 4 | Run 5 |
|---|---|---|---|---|---|
| sodium chloroacetate | 10 | — | 10 | 37 | 37 |
| sodium carbonate | 2 | — | 2 | 6.6 | 6.6 |
| Protocol CM * (DMDHEU) | — | 10 | — | — | — |
| Protowet CMS * (wetting agent) | — | 0.2 | 0.2 | — | 0.2 |
| Blue J Ultralux * (softener) | — | 6 | 6 | — | 6 |
| Marksoft HP * (softener) | — | 3 | 3 | — | 3 |
| Curite 5361 * (softener) | — | 2.5 | — | — | — |
| Ratings: | | | | | |
| Washed and Tumble dried | 3.5 | 3.5 | 3.0 | 3.0 | 3.5 |
| Washed and Line-dried | 3.0 | 3.5 | — | — | — |
| Washed and Drip-dried | 3.5 | 3.0 | 3.0 | — | — |
| (NO TREATMENT-2) | | | | | |

*Registered trademark of Sybron Chemicals, Inc.

Based on the ratings recorded above, fabrics treated with the anionic agent alone were smoother, more free of wrinkles, than the untreated fabric and were nearly as smooth, after washing, as fabric treated with a conventional crosslinker.

Example 9

This example illustrates the possible utility of a metal salt of sulfamic acid as a catalyst to promote the crosslinking of cellulose by a DMDHEU resin.

Three sets of experiments were conducted.

In the first set, cotton fabrics were treated with a DMDHEU resin and a magnesium sulfamate solution. These fabrics were subsequently washed with a detergent solution which was deliberately contaminated with a red anionic dye. The treated fabric resisted staining. Removal of the resin by acid treatment and subsequent washing, again with dye in the wash, indicated that the resin itself, as well as the cellulose, is resistant to anionic staining.

In the second set of experiments, one group of fabrics was treated with DMDHEU resin and conventional catalyst and another group of fabrics was treated with DMDHEU resin and a magnesium sulfamate solution. In this second set, the fabrics were tested for their ability to recover from creasing.

Details of the application procedure are summarized below.

The amount of Resin and Catalyst (in % OWB) used are summarized in Table 7. Also included in Table 7 are the crease angles and resin fixations associated with various treatments. The crease angles indicate the resiliency imparted to the fabrics and were determined according to the AATCC standard method no. 66-1990. The higher the number, the more resistant the fabric is to wrinkling, and one can infer, the better the crosslinking. The resin fixations were calculated from the amount of nitrogen determined by Kjeldahl techniques on fabrics before and after washing. The nitrogen content of a fabric sample is directly related to the amount of resin that is applied and the % resin fixation is the percent resin that remains permanently bound to the fabric during washing.

Application procedure:

1) Prepare the finish bath by mixing the resin into 80° F.–90° F. water and diluting with water until the total amount of water has been added.
2) Add the catalyst to the solution after all the water is in.
3) Apply the finish solution to fabric be expression-nip techniques to a wet-pick-up of 75%.
4) Dry the fabric in a horizontal Benz oven for 2 minutes at 200° F.
5) Cure the fabric at 400° F. for 12 seconds.

TABLE 7

| Chemical | Amounts % OWB (On Weight Bath) | | | | | |
|---|---|---|---|---|---|---|
| Run No. | 5 | 6 | 7 | 8 | 9 | 10 |
| Protorez 6041 B * | 10 | 12 | — | — | — | — |
| Protorez 6041 B Base ** | — | — | 10 | 10 | 12 | 12 |
| F1998G *** | — | — | 1.5 | 2.0 | 1.5 | 2.0 |
| Crease Angle (deg) | 265 | 270 | 266 | 261 | 283 | 286 |
| Nitrogen Fixation (%) | 89% | 96% | 90% | 70% | 97% | 82% |

*Combination of DMDHEU resin and conventional catalyst
**DMDHEU resin base used in Protorez 6041 B
***Magnesium sulfamate solution (52.24% water, 39.51% sulfamic acid, 8.25% magnesium oxide)

Comparing run 5 to run 7 and run 6 to run 9, we see a higher crease angle when the sulfamate catalyst is used. Also, it is evident that the difference in crease angles between the conventional and the sulfamate catalysts increases as the level of resin increases.

Comparing run 7 to run 8 and run 9 to run 10, we see that an increase in catalyst level results in a reduction in crease angle. This is to be expected. Cellulose can be hydrolyzed under acid conditions, and to increase the level of magnesium sulfamate is to increase the level of Lewis Acid.

In the third set of experiments one group of fabrics was treated with a conventional resin and a conventional catalyst and another group was treated with the same conventional resin but a magnesium sulfamate catalyst. The resulting anionic fabrics were tested to determine the effects of the catalysts on strength and dimensional stability.

The fabrics were treated according to the procedure outlined below and the compositions of the treating solutions, as well as the test results are summarized in Table 8.

Procedure:

Step 1) Set water temperature to 80° F.–90° F. and add resin

Step 2) Add Tanasoft (softener) and Protowet (wetting agent) and mix

Step 3) Add catalyst as the last ingredient and mix

Step 4) Apply to fabric by expression nip techniques to a wet-pick-up of about 61%

Step 5) Attach securely to frame to insure that the dimensions do not change in subsequent steps Step 6) Dry in Benz oven at 250° F. for 1.5 minutes Step 7) Cure in Benz oven at 325° F. for 1.5 minutes

TABLE 8

| Chemical (% OWB) | Bleached Only | 1 | 2 | 3 | 4 |
|---|---|---|---|---|---|
| Protocol CM * | — | 10% | 8% | 10% | — |
| Protowet CMS ** | — | 0.5% | 0.5% | 0.5% | 0.5% |
| Tanasoft PTX *** | — | 2.0% | 2.0% | 2.0% | 2.0% |
| Curite 5361 *** | — | 2.5% | — | — | — |
| F1998G | — | — | 2.0% | 2.5% | — |

| Test | Bleached Only | 1 | 2 | 3 | 4 |
|---|---|---|---|---|---|
| Tensile | (lbs) | (lbs) | (lbs) | (lbs) | (lbs) |
| Warp | 92.33 | 64.16 | 81.33 | 83.2 | 93 |
| Fill | 93.33 | 63.5 | 77.7 | 73.6 | 82 |
| Tear | (lbs) | (lbs) | (lbs) | (lbs) | (lbs) |
| Warp | 3.52 | 4.77 | 6.2 | 6.1 | 10.2 |
| Fill | 3.30 | 4.22 | 5.7 | 5.8 | 8.8 |
| Shrinkage | 6% | 2.0% | 2.5% | 2.3% | — |
| Warp | 2.3% | 0.7% | 0.8% | 0.8% | — |
| Fill | | | | | |
| Wet Crease Angle Warp | 128° | 180° | 152° | 164° | 126° |
| Filling | | | | | |
| Dry Crease Angle Warp | 187° | 253° | 224° | 238° | 179° |
| Fill | | | | | |
| Flex Abrasion Warp | 181 Cycles | 303 Cycles | 894 Cycles | 834 Cycles | 1217 Cycles |
| Fill | | | | | |

*Registered Trademark of Sybron Chemicals Conventional DMDHEU
**Registered Trademark of Sybron Chemicals, Inc.-Conventional Wetting Agent
***Registered Trademark of Sybron Chemicals, Inc. Conventional Textile Softener
****Registered Trademark of Sybron Chemicals, Inc. Conventional Buffered Crosslinking Catalyst (All these tests are standard AATCC Test Methods)

The column headed "bleached only" is for reference only. It illustrates the state of an unfinished fabric. The experiments test the effect of the resin and catalyst combination only, so the primary control in this set is Run 4, which has all the components of the bath which are constant (the softener, the wetter and the amount of water) but it has no resin or catalyst.

Comparing Run 4 to Runs 1, 2, and 3, the effects of the resin are evident. There is a loss of tensile strength compared to Run 4, a loss in tear strength, an increase in the crease angles, an increase in the flex abrasion cycles and a decrease in shrinkage. All these changes are advantageous except the tensile and tear strength losses. One of the advantages of the sulfamate chemistry is that at equivalent degrees of curing, there is not as great a loss in tensile or tear strength when the acidity required for crosslinking comes from sulfamic acid or a salt thereof. Based on the crease angles of runs 1, 2 and 3, curing did occur in theses samples; but, comparing the tensile and tear strengths of runs 2 and 3 to run 1, it is evident that the sulfamate based catalyst allows a higher strength which means that the fabric is less damaged.

Example 10

This example demonstrates the benefits of using a pre-formed urea-sulfamic acid complex when generating anionic charges on cotton fibers.

Four sets of experiments were conducted. In each experiment, 100% cotton 3×1 twill fabrics were treated by applying aqueous solutions of either a simple mixture or pre-formed complex of an anionic charge generating agent. The simple mixture used in this example was formulated as follows. First, the following ingredients were combined:

| Ingredients | Weight Percent |
|---|---|
| Water | 36.2% |
| Sulfamic Acid | 40.0% |
| Ammonia | 23.8% |

Seventy-five (75) grams of the above mixture was combined with 100 grams of urea. After urea was added, water was added to the mixture to form a 1 liter solution.

The preformed complex, on the other hand, was made from the following ingredients:

| Ingredients | Weight Percent |
|---|---|
| Urea | 37.5% |
| Sulfamic Acid | 10.0% |
| Phosphoric Acid (75.5%) | 2.5% |
| Water | 50.0% |

To form the complex, the sulfamic acid, the urea, and the phosphoric acid were heated to a temperature of 130° C. until the entire mass completely melted. After the mass melted, 300 grams of the composition was mixed and diluted with water to form a 1 liter solution.

Both of the above formulations delivered the same amount of sulfamic acid to the fabric.

Each respective solution was heated to 100° F. and applied to the cotton fabrics to a wet pick-up of 60% using expression-nip techniques. The wet fabrics were then stretched on a pin frame and heated in a horizontal laboratory Benz oven to dry and to react them with the solution. After heating, the fabrics were then rinsed and soaped to remove any unreacted materials. In each of the four experiments, 30 g/L of sulfamate, calculated as sulfamic acid, was delivered to the fabrics.

After treating the fabrics with the appropriate solution, the fabrics were then dyed with solutions of anionically charged dye, i.e. Direct Red 79, to test the dye-resistance of the treated fabrics. Any anionic charge on the fabric would repel the anionically charged dye such that a lighter resulting shade would indicate a stronger anionic charge on the fabric.

In the first experiment, two samples were prepared by simultaneously adding solid beads of urea and ammonium sulfamate to water to form a simple mixture. Ammonium sulfamate and urea were present at concentrations of 75 g/L and 100 g/L, respectively. Two samples were tested, one of which was heated for 2 minutes to 300° F. while the other was heated for 2 minutes to 340° F. After applying the dye, it was determined that the sample heated to 300° F. was less effective because it was a darker shade than the other sample.

In the second experiment, two samples were prepared. The first sample was identical to the samples of the first experiment. The second sample was prepared from a urea-sulfamic acid complex at a concentration of 300 g/L, which provided the equivalent amount of sulfamic acid to the fabric as in the first sample. Both samples were heated for 2 minutes to 300° F. After applying the dye and comparing the shades of each sample, it was determined that the sample treated by the complex was more effective because it had a lighter shade than the sample prepared with a simple mixture.

In the third experiment, two samples, identical to the samples of the second experiment, were prepared. However, in this experiment, the sample treated with the mixture was heated to 340° F., while the sample treated with the complex was only heated to 300° F. By comparing the shades of the samples after dyeing, it was determined that the sample treated with a complex was as effective as the sample treated with a mixture and heated to a higher temperature.

In the fourth experiment, samples treated with a urea-sulfamic acid complex (300 g/L) were again compared to samples treated with a simple mixture of urea and ammonium sulfamate (75 g/L of sulfamic acid, 100 g/L of urea). In this experiment, 1 g/L of Protwet CMS (a solution of an ethoxylated decyl alcohol) was also added to each sample, which acts as a wetting agent. Samples prepared with each form of aqueous solution were heated to 240° F. for 3 min, 4 min, 5 min, 6 min, 7 min, and 8 minute time intervals. For each time period tested, it was determined that samples treated with the complex demonstrated remarkably lighter shades than the samples treated with a simple mixture, thus indicating the effectiveness of the complex at lower temperatures.

Example 11

This example demonstrates the ability of applying additional sulfamic acid to a urea-sulfamic complex to prevent "misting" of the urea during curing at temperatures of 340° F. or higher.

In this experiment, two samples of 100% cotton 3×1 twill fabrics dyed with a khaki shade were prepared. The first sample was treated with a standard urea-sulfamic acid complex of the present invention, while the second sample was treated with the same complex containing an additional amount of ammonium sulfamate added after formation of the complex.

In particular, the first sample contained the following which were formed into a complex:

| Ingredients | Weight Percent |
|---|---|
| Urea | 37.5% |
| Sulfamic Acid | 10.0% |
| Phosphoric Acid (75.5%) | 2.5% |
| Water | 50.0% |

In constructing the second sample, the same ingredients listed above were combined in order to form an initial urea-sulfamic acid complex as follows:

| Ingredients | Weight Percent |
|---|---|
| Urea | 18.8% |
| Sulfamic Acid | 5.0% |
| Phosphoric Acid (75.5%) | 1.2% |
| Water | 25.0% |

After the initial complex was formed, the following ingredients were then added:

| Ingredients | Weight Percent |
|---|---|
| Water | 34.1% |
| Sulfamic Acid | 10.0% |
| Aqua Ammonia | 5.9% |

The sulfamic acid and aqua ammonia were added in stoicheometric amounts to form ammonium sulfamate. The ammonium sulfamate became bound to any free urea.

Both complexes were prepared at concentrations of 240 g/L. The complexes were then heated to a temperature of 100° F. and applied to the cotton fabrics to a wet pick-up of 55% using expression-nip techniques. The wet fabrics were then stretched on a pin frame and heated in a horizontal laboratory Benz oven to dry and to react them with the solution. Each sample was heated to a temperature of 340° F. for 2 minutes.

During heating, a substantial mist resulted from heating the fabric treated with the urea-sulfamic acid complex (containing no ammonium sulfamate), while no mist resulted from heating the same complex containing the ammonium sulfamate.

After heating, each sample was then rinsed in warm water and dried. Upon drying, the ability of each sample to resist cross-staining was tested by dipping the fabrics into solutions of cherry Kool-Aid, which contains anionically charged red dye, and Basic Violet 16, a cationic dye. For the anionic dye, a lighter resulting shade would indicate a stronger anionic charge of the treated fabric. In contrast, for the cationic dye, a darker resulting shade would indicate a stronger anionic charge of the treated fabric.

The resulting shades of the dyed samples indicated that the standard complex and the complex containing ammonium sulfamate resulted in the same degree of anionic charge on the fabric. This demonstrates the overall effectiveness of adding ammonium sulfamate to the complex in order to prevent misting, while still retaining the anionic charge generation capabilities of a complex of the present invention.

Example 12

The following experiment was done to determine the amount of sulfur deposited on a fabric treated in accordance with the present invention.

Specifically, various treated and untreated samples were prepared. The samples were then sent to a commercial laboratory for a determination of sulfur levels permanently bound to the fabric. The commercial laboratory analyzed the samples using a PE 2400 Series II CHNS/O Analyzer obtained from Perkin Elmer, which is an organic elemental analyzer.

A total of 5 samples were prepared from 100% bleached cotton print cloth. The prepared samples were as follows:

Sample No. 1: Control

Sample No. 2: 25 g/L of a 40% ammonium sulfamate solution was prepared. The solution was padded onto the cotton fabric at between 80° F. and 90° F. with a 70% wet pick-up rate. The fabric was dried at 210° F. for 2 minutes and then cured at 300° F. for 5 minutes. After curing, the fabric was rinsed and neutralized with a soda ash solution.

Sample No. 3: This sample was prepared identical to Sample No. 2 but was not rinsed and neutralized after being cured.

Sample No. 4: This sample was prepared similar to Sample No. 2 but was not cured, rinsed or neutralized.

Sample No. 5: A sample of the bleach cotton fabric was rinsed and neutralized in a soda ash bath.

After the samples were prepared, it was verified that Sample No. 2 repelled anionically charged dyes. Theoretically, it was also calculated that 0.1968% sulfur by weight was deposited on the fabric. For all of the samples, however, the commercial laboratory reported that no sulfur was detected. The detection limit of the instrument was 0.005%.

Example 13

The following example demonstrates the improved affinity of fabrics treated in accordance with the present invention for softeners.

As cotton is slightly anionic in nature, cationic auxiliaries, such as softeners, have a slightly higher affinity than nonionics. By increasing the degree of anionicity of the cotton, there should be an increase in the rate of exhaustion and an increase in the amount of cationic softener adsorbed onto the surface.

In the garment industry, there is great interest in producing garments with unique hand. Of particular interest, is a hand that is very soft and buttery that gives cotton better drape. Normally, this is achieved with high levels of fatty amide and silicone combinations. However, it is usually difficult to obtain a soft drape with softener alone. Cellulase enzymes are usually employed to break down the cotton slightly to reduce the bulk and improve drape.

In this Example, the following softeners were selected because of the soft, oily type hand that is produced on cotton. Other cationic softeners could be used and a similar effect is predicted.

| Softener | Type |
|---|---|
| BLUE-J ULTRALUX | Amino-silicone fluid emulsified with nonionic emulsifiers |
| TANASOFT HCA | Fatty quaternary type softener |
| SILQUAT AT 5-52 | Proprietary organomodified polydimethylsilicone |

-continued

| Softener | Type |
|---|---|
| SILQUAT AT-5-49 | Proprietary organomodified polydimethylsilicone |
| KELMAR 1964 | Amino-silicone fluid emulsified with cationic emulsifiers |

BLUE-J ULTRALUX and TANASOFT HCA softeners are available from Sybron Chemicals, Inc. of Wellford, S.C. SILQUAT AT 5-52 and SILQUAT AT 5-49 are available from the Silatech Corporation of Toronto, Ontario. KELMAR 1964 is an experimental product marketed by Kelmar Industries, Inc. of Duncan, S.C.

Fabrics Tested

100% Cotton Twill (Galey & Lord Harpoon)

55% Cotton 45% Linen

Fabric samples were dipped in 16% owb of a derivatising solution made in accordance with the present invention in water and extracted to 70% wet pick up. The derivatising solution was the same solution described in Example 11 above used to treat the second sample in that experiment.

The fabric was dried and cured at 300° F. for 5 minutes. Control samples that were untreated were rinsed and dried.

Softeners were applied at 2% and 4% owg at 120° F. for 10 minutes at pH 5.0. After the softener was applied, the fabric was dried at 180° F. for 40 minutes.

Results

The hand is evaluated by a panel of 4 and is rated on a scale of 1–10.

| | Treated | | Untreated | |
|---|---|---|---|---|
| Softener | 2% | 4% | 2% | 4% |
| BLUE-J ULTRALUX | 3 | 4 | 2.5 | 4 |
| TANASOFT HCA | 2.5 | 5 | 1.5 | |
| SILQUAT AT 5-52 | 3 | 5 | 1.5 | 3 |
| SILQUAT AT-5-49 | 3 | 5 | 1.5 | 3 |
| KELMAR 1964 | 6 | 10 | 4 | 6 |
| BLUE-J ULTRALUX & TANASOFT HCA (1:2 ratio) | 4 | 7 | 2 | 4 |

As can be seen from the data, for each level of cationic softener applied to the treated fabric, the hand is rated higher than the non-treated fabric.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A process for increasing the softness of a textile product containing cotton fibers, said process comprising the steps of:

contacting cotton fibers used to make said textile product with a solution containing a sulfating agent;

heating said cotton fibers to a temperature sufficient for said sulfating agent to react with said cotton fibers, said sulfated cotton fibers having an increased anionic charge, said sulfating agent reacting with said cotton fibers in an amount such that said cotton fibers contain sulfur in an amount less than 0.5% by weight;

contacting said cotton fibers with a solution containing a softener, said softener forming a bond with said sulfated cotton fibers.

2. A process as defined in claim 1, wherein said softener comprises a silicone.

3. A process as defined in claim 1, wherein said softener comprises a material selected from the group consisting of an amino siloxane, a fatty amide, a polysilicone, and mixtures thereof.

4. A process as defined in claim 1, wherein said sulfating agent comprises a material selected from the group consisting of sulfamic acid and a sulfamate.

5. A process as defined in claim 1, wherein said sulfating agent comprises a complex formed from sulfamic acid and urea.

6. A process as defined in claim 1, wherein said softener is cationic.

7. A process as defined in claim 1, wherein said softener solution comprises at least one emulsifier.

8. A process as defined in claim 7, wherein said emulsifier comprises a material selected from the group consisting of a siloxane, a quaternary amine, an ethoxylated alcohol, and mixtures thereof.

9. A process as defined in claim 1, wherein said fibers contain sulfur in an amount less than 0.05% by weight.

10. A process as defined in claim 1, wherein said sulfating agent is present within said solution at a concentration of up to 40 grams per liter.

11. A process for increasing the softness of a textile product containing cotton fibers, said process comprising the steps of:

contacting a textile product containing cotton fibers with a solution containing a sulfating agent, said sulfating agent comprising sulfamic acid or a sulfamate;

heating said textile product to a temperature sufficient for said sulfating agent to react with said cotton fibers, said sulfated cotton fibers having an increased anionic charge, said cotton fibers reacting with said sulfating agent such that said cotton fibers contain sulfur in amount up to about 0.5% by weight;

contacting said cotton fibers with a cationic softener solution, said softener forming an attachment with the textile product.

12. A process as defined in claim 11, wherein said softener comprises a silicone.

13. A process as defined in claim 11, wherein said softener comprises a material selected from the group consisting of an amino siloxane, a fatty amide, a polysilicone, and mixtures thereof.

14. A process as defined in claim 1, wherein said sulfating agent comprises a complex formed from sulfamic acid and an amide of a carboxylic acid.

15. A process as defined in claim 14, wherein said amide of a carboxylic acid comprises urea.

16. A process as defined in claim 11, wherein said softener solution comprises a cationic emulsifier.

17. A process as defined in claim 11, wherein said softener solution comprises an emulsifier, said emulsifier comprising a material selected from the group consisting of a siloxane, a quaternary amine, an ethoxylated alcohol, and mixtures thereof.

18. A process for increasing the softness of a textile product containing cotton fibers, said process comprising the steps of:

contacting cotton fibers used to make said textile product with a solution containing a sulfating agent, said sulfating agent comprising a complex formed between sulfamic acid and an amide of a carboxylic acid;

heating said cotton fibers to a temperature sufficient for said sulfating agent to react with said cotton fibers, said sulfated cotton fibers having an increased anionic charge, said cotton fibers being reacted with said complex such that said cotton fibers contain sulfur in an amount up to about 0.5% by weight; and contacting said cotton fibers with a cationic softener solution, said cationic softener solution containing a softener which becomes attached to said textile product, said softener comprising a silicone.

19. A process as defined in claim 18, wherein said sulfating agent is contained in said solution in an amount up to about 40 grams per liter.

20. A process as defined in claim 18, wherein said cationic softener solution is supplied to said cotton fibers by dipping said textile product into said cationic softener solution.

21. A process as defined in claim 18, wherein after said cotton fibers have been contacted with said cationic softener solution, said fibers are dried at a temperature of from about 160° F. to about 190° F.

22. A process as defined in claim 18, wherein said amide of a carboxylic acid comprises urea.

23. A process as defined in claim 18, wherein said textile product comprises a garment.

* * * * *